United States Patent [19]

Collins et al.

[11] 4,016,334

[45] Apr. 5, 1977

[54] METHOD OF APPLYING HIGH ADHESION ULTRAVIOLET CURABLE COATINGS AND COATED ARTICLES

[75] Inventors: George L. Collins, Murray Hill; John R. Costanza, North Plainfield, both of N.J.

[73] Assignee: Celanese Corporation, New York, N.Y.

[22] Filed: Feb. 18, 1975

[21] Appl. No.: 550,337

[52] U.S. Cl. ..... 428/463; 428/461; 204/159.22; 204/159.23; 427/54; 427/46; 427/409

[51] Int. Cl.[2] ..... B05D 3/06

[58] Field of Search ..... 427/54, 44, 46, 53, 427/409, 379, 388; 204/159.22, 159.23; 428/461, 462, 463

[56] References Cited

UNITED STATES PATENTS

| | | | |
|---|---|---|---|
| 3,061,459 | 10/1962 | Bader | 427/409 |
| 3,410,719 | 11/1968 | Roper | 428/462 |
| 3,785,855 | 1/1974 | Sausaman | 427/409 |

*Primary Examiner*—John H. Newsome

[57] ABSTRACT

An improved process for applying an ultraviolet curable coating to tin free steel is disclosed in this invention, whereby prior to applying the main ultraviolet curable composition, a thin pre-coating of a monomer containing at least one ultraviolet polymerizable site of alpha beta ethylenic unsaturation and at least two carbonyl groups is first applied to the surface to be coated, to a thickness of at least about $10^{-3}$ microns, and heated at temperatures ranging from 50° to 125° C. for 5–25 minutes. Following this step, an ultraviolet curable coating composition is applied and cured.

9 Claims, No Drawings

METHOD OF APPLYING HIGH ADHESION ULTRAVIOLET CURABLE COATINGS AND COATED ARTICLES

BACKGROUND OF INVENTION

This invention relates to ultraviolet curing processes and more particularly to an improved process for obtaining coatings having improved adhesion to tin free steel.

The search for essentially solvent-free, non-polluting, low energy-utilizing coating application methods has led to the rapidly increasing use of ultraviolet curable coating systems. However, because of the inherently low temperatures utilized in curing ultraviolet compositions, the adhesion of the cured film to the desired substrate has been poor. In particular, ultraviolet curing coatings applied to tin free steel have exhibited tendencies to peel off the substrate and have been particularly subject to chemical attack between the substrate and the coating itself.

Thus, it is an object of this invention to prepare ultraviolet curable coatings compositions having improved adhesion to various substrata, in particular, tin free steel.

It is another object of this invention to prepare ultraviolet curable coating compositions which are resistant to chemical attack and which cure rapidly under normal ultraviolet curing conditions.

SUMMARY OF INVENTION

These and other objectives are achieved by applying ultraviolet curable coating compositions to tin free steel or other difficult-to-adhere-to substrata by the process of ths invention. Basically, this process involves the application of two separate coatings. In the first coat, a monomer containing less than about 12 carbon atoms per molecule, at least one site of alpha beta ethylenic vinyl unsaturation which is crosslinkable by the application of ultraviolet light, at least two carbonyl groups per molecule, and no other groups interferingly reactive with the ultraviolet-vinyl unsaturation curing mechanism, the unsaturation groups themselves, or the photoinitiators, as are described hereinafter, is applied to the substrate to be coated to a thickenss of at least $10^{-3}$ microns. This coating is then heated at a temperature of 50°–125° C. for a period of 5–25 minutes, or subjected to microwave radiation for about 15–60 seconds. Following the application of this initial coating, an ultraviolet curable coating composition containing about 40 to about 100 percent, by weight, based on the total curable composition, of an alpha beta ethylenically unsaturated vinyl polymerizable compound having at least about two sites of vinyl unsaturation, up to about 60 percent, by weight, on the same basis, of an alpha beta ethylenically unsaturated vinyl polymerizable compound having a single site of alpha beta ethylenic unsaturation and copolymerizable with the initial coating, and the polyunsaturated monomer, and about 0.1 to about 15 percent, by weight, based on the curable composition, of an ultraviolet photoinitiator.

DESCRIPTION OF INVENTION

As previously described, the instant invention involves a two-coat process for use in ultraviolet curable coatings. The monomer useful in preparing the first coating of this invention must contain:

1. at least one ultraviolet polymerizable site of alpha beta ethylenic unsaturation;
2. no more than about 12 carbon atoms per molecule, and preferably about 6 to about 10 carbon atoms per molecule;
3. at least two carbonyl groups per molecule; and
4. no other groups interferingly reactive with the ultraviolet-vinyl unsaturation cure mechanism, the unsaturated groups themselves, or the photoinitiators, as described hereinafter.

Examples of the materials which fall within this category are for the most part the polyacrylates of polyols. Included among the polyols are ethylene glycol, propylene glycol, hexanediol and generally any of the 1-6 carbon diols and their respective polyethers. Also included are the triols, such as trimethylolpropane, trimethylolethane, glycerine, and the tetrapolyols, such as pentaerythritol. Thus, examples of the materials include hexanediol diacrylate, propylenediol diacrylate, ethylene glycol diacrylate, cyclohexanediol diacrylate, trimethylolpropane and trimethylolethane di- and triacrylate, pentaerythritol, di-, and tri- acrylate, and the like. Also included, although not as preferred, are the methacrylate and ethacrylate esters of the aforementioned polyols. Additional compounds include ester-acrylates, such as the esters of hydroxyalkyl acrylates, e.g., 2-hydroxyethyl acrylate acetate, and the like. The most preferred monomers are the glycol diacrylates based upon the 2–6 carbon atom-containing glycols.

This initial coating may be compounded with up to about 5 percent, by weight, based on the total first coating composition, of an ultraviolet photoinitiator as described hereinafter, although this step is not necessary with the photoinitiator in the second coating usually being sufficient to cure the first coating also. The first coating may also be compounded with the various photosensitizer accelerators as described hereinafter.

The initial layer of the instant invention may be applied by any conventional application means, including dipping, spraying, brushing, curtain coating, roll coating, and the like. In a particularly preferred process, the coating is applied to the desired substrate and then the substrate is subjected to a metal edge so as to remove all except an extremely thin coating of the initial material. No matter what procedure is used, however, an initial film thickness of at least about $10^{-3}$ microns, preferably $10^{-2}$ to $10^{-3}$ microns, is preferred.

The resulting coating is then subjected to a "precure" step which involves heating, utilizing standard heat or infrared radiation at a temperature of about 50°–125° C. for about 5–25 minutes, or instead of using infrared or oven heat, microwave radiation exposure for about 15–60 seconds may be utilized.

The second coating of this invention contains an ultraviolet curable mixture. The first component of this mixture is from about 40 to about 100 percent, by weight, based upon the total curable composition of the second coating, of an alpha beta ethylenically unsaturated vinyl polymerizable compound containing at least two vinyl polymerizable groups per molecule. Included are unsaturated esters of polyols and particularly such esters of the alpha methylene carboxylic acids., e.g., ethylene diacrylate, diethylene glycol diacrylate, glycerol diacrylate, glycerol triacrylate, ethylene dimethacrylate, 1,3-propanediol dimethacrylate, 1,2,4-butanetriol trimethacrylate, 1,4-cyclo-hexanediol diacrylate, 1,4-benzenediol dimethacrylate, penetaerythritol tri- and tetra- acrylate and methacrylate, dipentaerythritol hexacrylate, tripentaerythritol octaacrylate, sorbitol hexacrylate, 1,3-propanediol diacrylate, 1,5-pentanediol dimethacrylate, the bis-acrylates and methacrylates of polyethylene glycols of a molecular weight of 200–1500, and the like; unsaturated amides, particularly those of the alpha methylene carboxylic acids, and especially those of alpha, omega-diamines and oxygen-interrupted omega-diamines, such as methylene bis-acrylamide, methylene bis-methacrylamide, ethylene bis-methacrylamide, 1,6-hexamethylene bis-acrylamide, diethylene triamine tris-methacrylamide, bis(-gamma-methacrylamidopropoxy)ethane, beta-methacrylamidoethyl methacrylate, N-beta-hydroxyethyl-beta-(methacrylamido)ethyl acrylate and N,N-bis(-beta-methacrylyloxyethyl)acrylamide; vinyl esters such as divinyl succinate, divinyl adipate, divinyl phthalate, divinyl terephthalate, divinyl benzene-1,3-disulfonate, and divinyl butane-1,4-disulfonate. An outstanding class of these preferred addition polymerizable components are the esters and amides of alphamethylene carboxylic acids and substituted carboxylic acids with polyols and polyamides wherein the molecular chain between the hydroxyl and amino groups is solely carbon or oxygen-interrupted carbon.

The polyethylenic unsaturation can be present as a substituent attached to a preformed polymer resin, such as an alkyd, a polyester, a polyamide, or a vinyl homo- or copolymer. Also included are polymers containing maleic and fumaric acids or esters, as well as polymeric unsaturated materials prepared by reacting vinyl hydroxy or carboxy materials with polyepoxides, e.g., acrylic acid with the diglycidyl ether of bisphenol A. Also included are polymers such as polyvinyl acetate/acrylate, cellulose acetate/acrylate, cellulose acetate/methacrylate, N-acryloxymethylpolyamide, N-methacryloxymethylpolyamide, allyloxymethylpolyamide, etc.

In addition to the aforementioned polyfunctional polymerizable compounds, compounds containing a single polymerizable ethylenically unsaturated group of the structure $$>C=C<$$

can also be utilized. In addition to traditional "monomers", as described hereafter, the monounsaturated compounds may be polymeric materials, as previously described, containing on the average a single site of unsaturation on each polymer molecule.

These monomers can be aliphatic, aromatic, cycloaliphatic or any variant thereof. Among these monomers are included styrene, 4-methylstyrene, alphamethylstyrene, and the like; acrylic acid and its nitrile, amide and $C_1$–$C_{12}$ alkyl or aryl ester derivatives, such as acrylamide, ethylacrylate, 2-ethylhexyl acrylate, butoxyethoxyethyl acrylate, hydroxyethyl acrylate, as well as others; the vinyl halides such as vinyl chloride, vinylidene chloride, and the like; the vinyl esters such as vinyl acetate, vinyl butyrate, vinyl benzoate, and the like; vinyl ketones such as vinyl phenyl ketone, vinyl methyl ketone, alphachlorovinyl methyl ketone; and the like; the vinyl thioethers such as vinyl ethyl sulfide, vinyl p-tolylsulfide, divinyl sulfide, and the like. Other monomers include divinyl sulfone, vinyl ethyl sulfone, vinyl ethyl sulfoxide, vinyl sulfonic acid, sodium vinyl sulfonate, vinyl sulfonamide, vinyl pyridine, N-vinyl pyrrolidone, N-vinyl carbazole, and the like. Generally any alpha beta ethylenically unsaturated monomer which does not interfere with the ultraviolet curing mechanism may be utilized, and as such, these monomers are well known in the art.

These monomers may be added in amounts up to about 60 percent, by weight, based upon the total curable composition, preferably about 10 to about 30 percent.

The second coating of the instant invention can also contain up to about 60 percent, by weight, based upon the total curable system, of a polymeric material containing no polymerizable unsaturation. Among the polymers are the polyolefins and modified polyolefins, the vinyl polymers, the polyethers, the polyesters, the polylactones, the polyamides, the polyurethanes, the polyureas, the polysiloxanes, the polysulfides, the polysulfones, the polyformaldehydes, the phenol-formaldehyde polymers, the natural and modified natural polymers, the heterocyclic polymers and the like.

Illustrative of these polymers are the acrylic polymers as poly(acrylic acid), poly(methyl acrylate), poly(ethyl acrylate), poly(methacrylic acid), poly(methyl methacrylate), poly(ethyl methacrylate); poly(vinyl chloride); polyvinyl alcohol, poly(ethylene/propylene/5-ethylidenebicyclo[2.2.1]hept-2-ene; polyethylene, polypropylene; snythetic rubbers, e.g., butadiene/acrylonitrile copolymers and chloro-2-butadiene, 1,3 polymers; the polyesters, copolyesters, polyamides and copolyamides, such as caprolactone, poly(caprolactone/vinyl chloride), poly(ethylene glycol terephthalate), poly(hexamethylene succinate), poly(hexamethylene maleate), poly(hexamethylene carbonate), poly(-caprolactam), poly(hexamethylene adipamide), and the like; the polyethers such as poly(glutaraldehyde), polyethylene oxide, polypropylene oxide, poly(tetrahydrofuran), polycyclohexene oxide, copolymers of ethylene oxide and propylene oxide with starters containing reactive hydrogen atoms such as the mixed copolymer using ethylene glycol, glycerol, sucrose, etc., as the starter; vinylidene polymers and copolymers, e.g., vinylidene chloride/acrylonitrile; vinylidene chloride/-methacrylate and vinylidene chloride/vinyl acetate copolymers; ethylene/vinyl acetate copolymers; the polyureas and polyurethanes, such as described in *Polyurethanes: Chemistry and Technology*, Volumes I and II, Sanders and Frisch, published by Interscience Publishers, the polycarbonates, polystyrenes, polyvinyl acetals, e.g., polyvinyl butyral, polyvinyl formal; the cellulose ethers, e.g., methylcellulose, ethylcellulose, and benzyl cellulose; the cellulose esters, e.g., cellulose acetate, cellulose acetate succinate and cellulose acetate butyrate, as well as the natural and modified natural polymers such as gutta percha, cellulose, starch, gelatin, silk, wool and the like; the siloxane polymers and copolymers; the formaldehyde polymers such as polyformaldehyde, formaldehyde resins such as phenol-formaldehyde, melamine-formaldehyde, urea-formaldehyde, aniline-formaldehyde, and acetone-formaldehyde; phenolic resins and the like.

If desired, the photopolymerizable monomers can also contain immiscible polymeric or non-polymeric organic or inorganic fillers or reinforcing agents, e.g., the organophilic silicas, bentonites, silica, powdered glass, colloidal carbon, as well as various types of dyes and pigments, in amounts varying with the desired properties of the second photopolymerizable layer. The fillers are useful in improving the strength of the composition, reducing tack and in addition, as coloring agents.

In order to sensitize the compositions of the instant invention to ultraviolet light, certain photosensitizers or photoinitiators are utilized. These fall into many classes and include compounds such as benzoin derivatives, as disclosed in German Patent No. F52340IVC/396, acetophenone, propiophenone, xanthone, fluorenone, benzaldehyde, fluorene, anthraquinone, triphenylamine, carbazole, 3- or 4-methylacetophenone, 3- or 4-pentylacetophenone, 3- or 4-methoxyacetophenone, 3- or 4-bromoacetophenone, 3- or 4-allylacetophenone, p-diacetylbenzene, 3- or 4-methoxybenzophenone, 3- or 4-methylbenzophenone, 3- or 4-chlorobenzophenone, 4,4'-dimethoxybenzophenone, 4-chloro-4'-benzylbenzophenone, 3-chloroxanthone, 3,9-dichloroxanthone, 3-chloro-8-nonylxanthone, 3-methoxyxanthone, 3-iodo-7-methoxyxanthone, thioxanthones, chlorinated thioxanthones, and the like.

Also included are the acetophenone photosensitizers of the type described in U.S. Pat. No. 3,715,293, having the structure

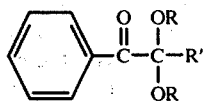

wherein R is alkyl of from 1-8 carbon atoms, or aryl with 6 carbon atoms, and R' is hydrogen, alkyl of from 1-8 carbon atoms, aryl of from 6–14 carbon atoms or cycloalkyl of 5–8 carbon atoms.

The alkylphenone type of photosensitizer having the formula

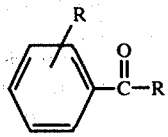

the benzophenone type photosensitizer having the formula

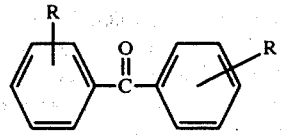

the tricyclic fused ring type having the formula

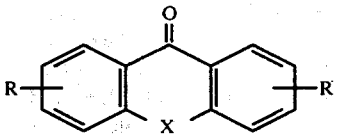

and the pyridyl type having the formula

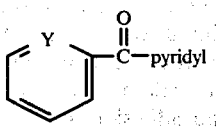

wherein the various substituents are as further described in U.S. Pat. No. 3,759,807.

Other photosensitizers include 1- and 2-choroanthraquinone, 2-methylanthraquinone, 2-tertiary butyl anthraquinone, octamethylanthraquinone, 1-4-napthoquinone, 9-10-phenanthrenequinone, 1,2-benzanthraquinone, 2-3-benzanthraquinone, 2-methyl 1,4-napthoquinone, 2-3-dichloronapthoquinone, 1-4-dimethylanthraquinone, 2-3-dimethylanthraquinone, 2-phenylanthraquinone, 2-3-diphenylanthraquinone, sodium salts of anthraquinone alphasulfonic acid, 3-chloro-2-methyl anthraquinone, and the like. Other photoinitiators which are also useful are described in U.S. Pat. No. 2,760,863 and include vicinal ketaldonyl compounds, such as diacetyl benzyl, etc., alpha ketaldonyl alcohols, such as benzoin, pivaloin, etc., acryloin esters, e.g., benzoin methyl and ethyl ethers, etc., alpha hydrocarbon substituted aromatic acyloins, including alphamethyl benzoin, alphaallyl benzoin, and alphaphenyl benzoin. Also included are the diacylhalomethanes, corresponding to one of the general formulas:

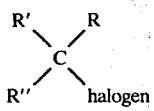

and

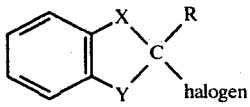

wherein halogen represents a halogen atom such as chlorine or bromine; R represents a hydrogen atom, a chlorine or bromine atom, or an acetyloxy group; R' and R'' (same or different) represent a benzoyl group, a nitrobenzoyl group, a dimethylamino benzoyl group, a phenyl sulfonyl group, a carboxy phenyl sulfonyl group, a methylphenyl sulfonyl group, or a napthoyl group; and X and Y (same or different) represent a carbonyl group or a sulfonyl group. Included are 2-bromo-1,3-diphenyl-1,3-propane dione, 2,2-dibromo-1,3-indane dione, 2,2-dibromo-1,3-diphenyl-1,3-propane dione, 2-bromo-2-(phenylsulfonyl acetal phenone) and the like, as further described in U.S. Pat. No. 3,615,455.

Other photoinitiators are cataloged by G. Delzenne in *Industrie Cimique Belge*, 24 (1959), 739–764. Most preferred among the initiators are benzoin isobutyl ether, benzophenone, and 2-chlorothioxanthone.

The photosensitizers should be added in an amount equal to about 0.1 to about 15 percent, by weight, based upon the total ultraviolet polymerizable system in the second coating, preferably about 1 to about 5 percent.

Although not required, certain organic amines can be added to the photosensitizers above-described to further enhance the cure rate of the compositions of the instant invention in amounts up to about 500 percent, by weight of the photosensitizer, preferably up to about 50 percent by weight. The amines can be primary, secondary, or tertiary, and can be represented by the general formula:

$$R''-\overset{\overset{\displaystyle R'}{|}}{N}-R'''$$

wherein R′ and R″ taken singly can be hydrogen, linear or branched alkyl having from 1 to about 12 carbon atoms, linear or branched alkenyl having from 2 to about 12 carbon atoms, cycloalkyl having from 3 to about 10 ring carbon atoms, cycloalkenyl having from 3 to about 10 ring carbon atoms, aryl having from 6 to about 12 ring carbon atoms, alkaryl having 6 to about 12 ring carbons atoms; R‴ has the same meaning as R′ and R″ with the exception that it cannot be hydrogen and that it cannot be aryl when both R′ and R″ are aryl. When taken together R″ and R‴ can be a divalent alkylene group $-(C_nH_{2n})-$ having from 2 to about 12 carbon atoms, a divalent alkenylene group $-(C_nH_{2n-1})-$ having from 3 to about 10 carbon atoms, a divalent alkadienylene group $-(C_nH_{2n-2})-$ having from 5 to about 10 carbon atoms, a divalent alkatrienylene group $-(C_nH_{2n-3})-$ having from 5 to about 10 carbon atoms, a divalent alkyleneoxyalkylene group $-(C_xH_{2x}OC_xH_{2x})-$ havign a total of from 4 to about 12 carbon atoms, or a divalent alkyleneaminoalkylene group.

$$-C_xH_{2x}\overset{\overset{\displaystyle R'}{|}}{N}C_xH_{2x}-$$

having a total of from 4 to about 12 carbon atoms. As previously indicated, the amines can be substituted with other groups; thus, the R′, R″ and R‴ variables, whether taken singly or together can contain one or more substituents thereon. The nature of such substituents is generally not of significant importance and any substituent group can be present that does not exert a pronounced deterrent effect on the ultraviolet crosslinking reaction.

Illustrative of suitable organic amines one can mention are methylamine, dimethylamine, trimethylamine, diethylamine, triethylamine, propylamine, isopropylamine, diisopropylamine, triisopropylamine, butylamine, tributylamine, t-butylamine, 2-methylbutylamine, N-methyl-N-butylamine, di-2-methylbutylamine, trihexylamine, tri-2-ethylhexylamine, dodecylamine, tridodecylamine, tri-2-chloroethylamine, di-2-bromoethylamine, methanolamine, ethanolamine, diethanolamine, triethanolamine, methyldiethanolamine, dimethylethanolamine, isopropanolamine, propanolamine, diisopropanolamine, triisopropanolamine, butylethanolamine, dihexanolamine, 2-methoxyethylamine, di-2-ethylhexylamine, tri-2-ethoxyethylamine, 2-hydroxyethyldiisopropylamine, 2-aminoethylethanolamine, allylamine, butenylamine, dihexadienylamine, cyclohexylamine, tricyclohexylamine, trimethylcyclohexylamine, bismethylcyclopentylamine, tricyclohexenylamine, tricyclohexadienylamine, tricyclopentadienylamine, N-methyl-N-cyclohexylamine, N-2-ethylhexyl-N-cyclohexylamine, diphenylamine, phenyldimethylamine, methylphenylamine, ditolylamine, trixylyl-amine, tribenzylamine, triphenethylamine, benzyldimethylamine, benzyldihexylamine, trischlorophenethylenimine, N-methylethylenimine, N-cyclohexylethylenimine, piperidine, N-ethylpiperidine, 2-methylpiperidine, 1,2,3,4-tetrahydropyridine, 1,2-dihydropyridine, 2-, and 3- and 4- picoline, morpholine, N-methylmorpholine, N-2-hydroxyethylmorpholine, N-2-ethoxyethylmorpholine, piperazine, N-methylpiperazine, N,N″-dimethylpiperazine, 2,2-dimethyl-1,3tribenzylamine, 3-(N-morpholinyl)-propionyloxy]propane, 1,5-bis[3-(N-morpholinyl)-propionyloxy]diethyl ether, and the like. The preferred organic amines are the tertiary amines, with the alkanol amines being most preferred. The specific preferred amine activators are triethanolamine, morpholine and methyldiethanolamine.

The compositions of the instant invention after being prepared in the ratios as set out above can be applied to the previously coated substrate by conventional means, including brushing, spraying, dipping, curtain and roll coating techniques.

As previously set out, by carrying out the process of the instant invention, it is possible to obtain coatings having improved adhesion to tin free steel. In addition, however, improved adhesion is also evident where other substrata are coated. Examples of such substrata include wood, metal, paper, plastic, fabric, fiber, ceramic, concrete, plaster, glass, etc.

Typically a mixture of the composition of the instant invention in combination with the organic photosensitizer and, where utilized, the amine activator, is prepared and the composition applied to the desired substrate. It is then exposed to electromagnetic radiation having wave lengths of above about 2000 Angstrom units, preferably from about 2000 up to about 5000 Angstroms. Exposure should be from a source located about 1 to 5 inches from the coating for a time sufficient to cause crosslinking of the composition and can range from about 0.1 seconds up to about 1 min./linear ft. Generally, the light radiation will have power of about 200 watts per linear foot.

The light radiation can be ultraviolet light generated from low, medium and high pressure mercury lamps. This equipment is readily available and its use is well known to those skilled in the art of radiation chemistry.

In the following examples all parts and percentages are by weight unless otherwise indicated.

EXAMPLE 1

Hexanediol diacrylate was placed on a tin free steel panel and spread by drawing the edge of an inch square stainless steel bar across the surface. The coated substrate was placed in an oven for 10 minutes at 125° C.

After cooling, an ultraviolet coating composition comprising a mixture of 4 parts of an epoxy diacrylate prepared by coreacting one mole of the diglycidyl ether bisphenol A and 2 moles of acrylic acid at 60° C., 4.0 parts of trimethylolpropane triacrylate, 2.0 parts of N-vinyl pyrrolidone, 0.4 parts of benzoin isobutyl ether and 10 parts of anatase titanium dioxide, was prepared. The coating was applied to a thickness of 0.5 mils and cured on a Hanovia ultraviolet curing apparatus equipped with a medium pressure 100 watt lamp for five seconds. After curing, adhesion was evaluated by making a cross mark in the coating with a razor blade. Pressure-sensitive tape was placed on the cross mark and then rapidly lifted away. The adhesion was rated based on the amount of coating that removed. A numerical rating on a scale of 0–10 was assigned, with 0 being essentially no adhesion and 10 being excellent adhesion with no coating lifted by the tape.

EXAMPLE 2

Example 1 was repeated except that the substrate was not initially coated with hexanediol diacrylate.

EXAMPLE 3

Evaluation of Examples 1 and 2 according to the procedure set forth in Example 1 produced a 9–10 rating for Example 1 and a 0-1 rating for Example 2.

EXAMPLE 4

Example 1 was repeated except that the thermal treatment in the oven was replaced with 30 seconds exposure to microwave radiation. Similar results were obtained.

As can be seen from the above examples, when the hexanediol diacrylate pre-coating step is employed, an extreme increase in adhesion properties is observed.

What is claimed is:

1. A process for applying an adherent coating to a substrate which comprises:

a. applying a first coating consisting essentially of an ultraviolet curable monomer having at least one ultraviolet polymerizable site of alpha beta ethylenic unsaturation, no more than about 12 carbon atoms per molecule, at least about two carbonyl groups per molecule, having no other groups interferingly reactive with the alpha beta ethylenic unsaturation ultraviolet curing mechanism, and having no unsaturation other than alpha beta ethylenic unsaturation, to a coating thickness of about at least $10^{-3}$ microns;

b. treating said coating with heat, infrared or microwave radiation;

c. applying a second coating of an ultraviolet curable coating composition over said first coating wherein said second composition comprises about 40 to about 100 percent, by weight, based upon the total second coating curable composition, of an alpha beta ethylenically unsaturated vinyl polymerizable compound having at least two sites of ultraviolet polymerizable unsaturation and up to about 60 percent, by weight, on the same basis, of another alpha beta ethylenically unsaturated vinyl polymerizable compound containing one site of ultraviolet polymerizable vinyl unsaturation, about 0.1 to about 15 percent, by weight, based upon the total curable system in said coating, of a photoinitiator; and d. subjecting the coated substrate to ultraviolet radiation.

2. The process of claim 1 wherein said first coating is hexanediol diacrylate.

3. The process of claim 1 wherein said first coating contains an ultraviolet photoinitiator.

4. The process of claim 1 wherein the thickness of said first coating is in the range of about $10^{-2}$ to $10^{-3}$ microns.

5. The process of claim 1 wherein the photoinitiators are selected from benzoin isobutyl ether, 2-chloro-thioxanthone and benzophenone.

6. The process of claim 1 wherein the ultraviolet curable second coating composition contains an organic amine, in an amount up to about 500 percent, based on the weight of the photoinitiator.

7. The process of claim 1 wherein the first coating is subject to a temperature of about 50°–125° C. for about 5–25 minutes prior to the application of the second coating.

8. The process of claim 1 wherein the first coating is subject to microwave radiation for about 15–60 seconds.

9. The product prepared by the process of claim 1.

* * * * *